US007303163B2

(12) United States Patent
Huss et al.

(10) Patent No.: US 7,303,163 B2
(45) Date of Patent: Dec. 4, 2007

(54) METHOD AND SYSTEM FOR DELIVERING THREADS

(75) Inventors: Rolf Huss, Lossburg (DE); Norbert Bammert, Glatten (DE)

(73) Assignee: Memminger-IRO GmbH, Dornstetten (DE)

( * ) Notice: Subject to any disclaimer, the term of this patent is extended or adjusted under 35 U.S.C. 154(b) by 252 days.

(21) Appl. No.: 10/523,224

(22) PCT Filed: Jun. 20, 2003

(86) PCT No.: PCT/DE03/02065

§ 371 (c)(1),
(2), (4) Date: Jan. 31, 2005

(87) PCT Pub. No.: WO2004/016843

PCT Pub. Date: Feb. 26, 2004

(65) Prior Publication Data

US 2006/0184267 A1 Aug. 17, 2006

(30) Foreign Application Priority Data

Jul. 30, 2002 (DE) ..... 102 34 545

(51) Int. Cl.
*D04B 15/48* (2006.01)

(52) U.S. Cl. ..... 242/418.1; 700/130

(58) Field of Classification Search ..... 242/418.1, 242/419.9, 41, 412.1, 412.2, 410; 66/125 R, 66/146, 132 R; 700/141, 143, 136, 139, 700/140, 142, 130; 139/449, 116.1
See application file for complete search history.

(56) References Cited

U.S. PATENT DOCUMENTS 3,858,416 A 1/1975 White et al.
4,953,367 A * 9/1990 Memminger et al. ..... 66/132 R

FOREIGN PATENT DOCUMENTS

EP 0 452 800 A1 10/1991
EP 0 489 307 A1 6/1992
EP 1 176 244 A3 1/2002

* cited by examiner

*Primary Examiner*—Peter M. Cuomo
*Assistant Examiner*—William E Dondero
(74) *Attorney, Agent, or Firm*—Leydig, Voit & Mayer, Ltd.

(57) ABSTRACT

A yarn feeder system (1) includes a plurality of yarn feeders combined into one group (8). In the trial mode, the yarn feeders operate in an individually tension-controlled manner on the basis of a specified yarn tension value. The yarn feed quantities or yarn speeds that result from this at the various yarn feeders are reported to a central unit. From the reported yarn speeds, the central unit calculates a group average and sends this to the yarn feeders as a specified value for subsequent operation. As a result, the individual yarn feeders can subsequently operate in the purely positive mode. Moreover, the central unit can receive signals that characterize both the machine speed (rpm) and pattern signals, on the basis of which the yarn feeders of the particular group that is to respond at that time are switched on and off or speeded up or slowed down.

15 Claims, 4 Drawing Sheets

METHOD AND SYSTEM FOR DELIVERING THREADS

FIELD OF THE INVENTION

The invention relates to a method for feeding yarns to a textile machine, and also relates to a yarn feeder system.

BACKGROUND OF THE INVENTION

To produce textile goods, such as two-dimensional textile products by weaving or knitting, many textile machines require a plurality of yarn feeders, which feed yarns to various yarn-using stations. The task of the yarn feeder is to draw the yarn from a spool and furnish it to the knitting machine. So-called positive feed wheel units are known, which have a yarn feed wheel around which yarn wraps; the rotation of the yarn feed wheel determines the yarn feeding to the subsequent machine.

One such yarn feeder can be found in U.S. Pat. No. 3,858,416. The yarn feeder has an electric motor with a yarn feed wheel, and the yarn to be fed is wrapped around this wheel. The yarn trailing away from the yarn feed wheel travels via a yarn tension sensor to a knitting station of a circular knitting machine. Moreover, a position or rpm sensor is disposed both on the knitting machine and on the electric motor of the yarn feed wheel. A trigger circuit that drives the motor can then be connected to the position sensors or alternatively to the tension sensor via a reversing switch. In one case, the motor operates at an rpm that is proportional to the operating speed of the knitting machine. Yarn is fed to the knitting machine at a fixed yarn quantity per machine revolution. For a given operating speed of the knitting machine, the feeding speed is constant. The yarn tension varies freely within wide limits. This mode of operation is called the positive mode. The alternative mode of operation, which is attained by reversal of the switch block, is known as the tension-guided mode. In this case, the drive motor of the yarn feeder is triggered in such a way that the desired yarn tension is established. The yarn quantity that is fed as a result to the yarn-using machine varies freely within wide limits.

In knitting machines or other textile machines, it is often critical to feed a plurality of yarns parallel in such a way that uniform loop sizes are created.

From European Patent Disclosure EP 0 452 800 B1, monitoring of a knitting machine is known, with the goal of being able to produce knitted articles, such as pantyhose, to a uniform intended size. To that end, the precise rpm of the drive shaft of the textile machine is plotted in a learning cycle. The yarn motion is also plotted in a trial knitting sequence. The later operation of the knitting machine is then based on the plotted data.

It is also known from European Patent Disclosure EP 0 489 307 A1 for the yarn quantity fed to a yarn-using machine to be controlled by producing a sample product in a first step or learning step. The yarn quantity fed to the machine is recorded in this step. In a second step or production step, a product similar to the sample product is produced. Once again, the yarn quantities are determined and compared with the sample data. A yarn feeder system by way of which the yarn is delivered to the machine is then triggered on the basis of the data stored in memory.

Since the data are obtained in the sample knitting process in which the yarn is drawn from the spool by the tension of the machine itself but not by the yarn feeder, the loop size in the loops to be made is defined in a more or less random way.

BRIEF SUMMARY OF THE INVENTION

In view of the foregoing, it is the object of the invention to create a method for feeding yarns to a textile machine, and create a corresponding yarn feeder system for feeding a plurality of yarns to yarn-using stations, with which a knitted article with a uniform loop size can be created.

This object is attained by the feeding method and by the yarn feeder system of the invention.

In the yarn feeding method of the invention, a plurality of yarn feeders are operated in tension-controlled fashion in one or more trial phases. In the process, the yarn feeders attempt to feed yarns at a specified yarn tension. Depending on the yarn consumption of each knitting station connected, the result is individual yarn feed quantities and yarn feed speeds to the various yarn feeders. These yarn feed quantities or yarn speeds are detected and are made the basis for determining a set-point value, that is, a specified speed or a specified yarn quantity. Once the trial phase has elapsed, the yarn feeders receive a signal that characterizes the specified speed or the specified yarn quantity and then furnish the appropriate yarn quantities. As a result, the same loop size is ensured at all the knitting stations connected to the yarn feeders. The yarn tensions adjust themselves variously at the various yarn feeders.

In the simplest case, in the trial mode of operation, the yarn speed is constant at all the knitting stations. This is the case when plain goods are being made. Conversely, if patterned goods are being made, then the yarn quantity fluctuates. The fluctuation may be correlated with the rotary position of the needle cylinder and/or with the data of a pattern memory. In these cases, the central unit additionally receives signals which correspond to the rotary position of a circular knitting machine and/or to specified values from the pattern memory. In the trial mode, the central unit then determines the set-point yarn speed for each operating portion of the knitting machine in which the yarn consumption of the knitting stations is constant, on the premise that knitting stations without any yarn consumption are not included in the overall averaging operation. Instead, they are recognized as temporarily inactive knitting stations. Accordingly, the yarn speed set-point values of the yarn feeders assigned to them are set at a low set-point value, or zero.

In addition, to avoid yarn tension peaks upon acceleration or deceleration of the yarn (for instance in the sample mode), specified yarn quantities that precede the production phases are calculated.

This procedure can apply to all yarn feeders of a knitting machine or other kinds of textile machines. In a preferred embodiment, however, the yarn feeders are combined into groups, and the aforementioned procedure is employed individually for each group. The yarn feeders combined into one group are preferably those which are intended to perform synchronous yarn feeding. If patterns are to be made which require one group of yarn feeders either to be temporarily out of action or to feeds at different yarn speeds than yarn feeders of a different group, this can be easily attained by supplying the yarn feeders with corresponding set-point speed signals. The individual yarn feeders of each group can execute a positive mode of operation and nevertheless attain intermittent yarn feeding actions. To that end, they can for instance be supplied with a repeat signal and/or a needle signal and thus be synchronized with the knitting machine or other textile machine. Appropriate control signals can be generated by reading out and processing pattern data from a pattern memory.

It is also possible for the yarn feeders to be sent a yarn quantity signal which characterizes the yarn quantity per machine revolution. In this embodiment, in operation, the yarn feeders constantly receive signals, which determine the machine speed, from the central unit or from some other point. From this yarn quantity signal and the yarn quantity signal received before it, the yarn feeders then constantly determine the requisite yarn speed and regulate it. The yarn feeders then run synchronously, rigidly in phase with the machine. If individual yarn feeders are supposed to stop or feed different yarn quantities, then the central unit sends signals accordingly to the yarn feeders.

It is considered advantageous for the yarn feeders to be operated in the trial phase with matching set-point tensions. If needed, a departure may be made from this procedure, however. The matching set-point tensions preferably each apply to one group of yarn feeders that is later to be operated synchronously.

The yarn quantities or yarn speeds furnished by the yarn feeders in the trial phase are delivered as a signal, preferably in the form of digital data, to a central unit. From them, the central unit forms an average and outputs it again, as a set-point speed, to the yarn feeders that are combined into the group. With this procedure, the data traffic over the communications lines among the yarn feeders and the central unit is reduced to a minimum. Once the yarn feeders have received their set-point yarn speed value, they store it in memory and feed at the appropriate yarn speed. Further data transmission is required only, and not until, the yarn feed quantity is to be changed. Once they have received a set-point yarn quantity, they constantly require a speed signal for the machine speed.

It can suffice if the yarn speed to be ascertained during the trial phase is ascertained at only some yarn feeders in one group of yarn feeders. This is true particularly with relatively large groups and in cases in which only slight deviations in the feeding speed occur within one group of yarn feeders. However, it is considered advantageous, for the specified speed, to evaluate the yarn speeds of all the yarn feeders of one group of yarn feeders. The evaluation can be done in the form of an averaging operation. The average value may be either an arithmetic mean value or a geometric mean value or a mean value formed by other rules. For instance, yarn speeds of individual yarn feeders may also be disproportionately higher-weighted or lower-weighted, if they deviate too greatly from the average for the rest of the group.

It is also possible to perform the averaging operation multiple times by different methods. For instance, there can be a first trial run, in which the specified yarn speed has been formed as a geometric average of the individual yarn speeds. If in a subsequent yarn speed-controlled trial mode the resultant yarn tensions are then unsatisfactory, or in other words are too far apart, then the specified yarn speeds can be recalculated again in a second process, in which arithmetic averaging is for instance attempted, and it is checked in a new trial mode whether yarn tensions that are now close together are attained. If not, then for instance still another mean value can be formed, for instance as a square mean value for the yarn speed, and with it a new trial mode is then performed. It is furthermore possible to adapt the weighting factors adaptively in the averaging operation. To avoid excessively high yarn tensions, the feeding speeds, ascertained in the trial mode, of those yarn feeders that exhibit especially high yarn feeding speeds can then be disproportionately higher-weighted. If in the trial mode, with a specified yarn quantity or yarn speed, an excessively high or low yarn tension is found at individual knitting stations, then the weighting factors for the yarn speeds can be adapted in the averaging operation. For instance, high yarn speeds can be disproportionately lower-weighted, if excessively low yarn tensions have occurred in the speed-controlled operating mode. Conversely, the weighting factors of especially high feeding speeds ascertained in the tension-controlled mode can be increased, if in the ensuing speed-controlled trial mode excessively high tension peaks have occurred.

In one embodiment, the trial phase proceeds in two stages. In a first stage, the yarn feeders are operated with tension control, and the yarn speeds are recorded. After suitable averaging to ascertain a specified value for the yarn speed, what follows in a second stage is a trial mode at a specified yarn speed, to check the resultant yarn tensions.

Individual yarn feeders may also be used that have no yarn tension sensor. These yarn feeders, as slave devices, adopt the yarn feed wheel rpm of one or more master yarn feeders. This applies for both the tension-regulated and the speed-regulated modes of operation.

It is also possible to examine the individual yarn speeds as to whether they deviate excessively far from specified values. If so, this can be considered an indication of errors in or on the connected machine. In this way, incorrect operation, with the risk of yarn breakage or needle breakage, can be avoided.

Alternatively and/or in addition, it is possible during regular operation of the yarn feeder system to monitor the yarn tensions, either constantly or at random times and compare them with a set-point value. This provides the capability of generating an error signal, if the yarn tension differences ascertained (deviations in the yarn tension from an ideal value) exceed or fail to attain a specified value, or in other words become too high or too low. As the ideal value, the yarn tension value on which the trial mode is based can be employed.

Further details of advantageous embodiments of the invention will become apparent from the drawing, description, or dependent claims.

Exemplary embodiments of the invention are illustrated in the drawings, of which:

DETAILED DESCRIPTION OF THE INVENTION

Figure 1:
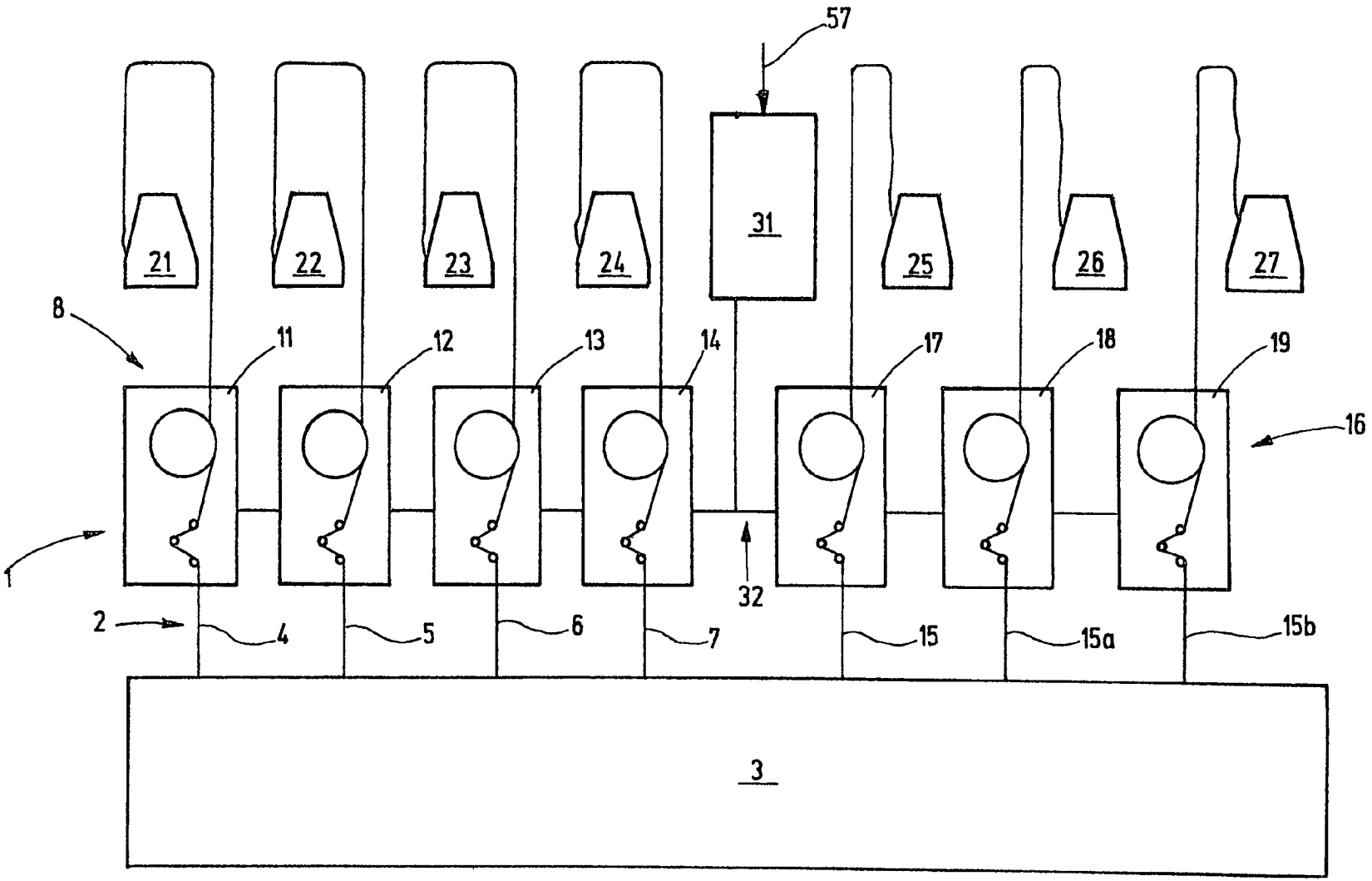
FIG. 1 is a schematic illustration of a textile machine with centrally controlled yarn feeders.

In FIG. 1, a yarn feeder system 1 for furnishing a plurality of yarns 2 to a knitting machine 3 or other kind of yarn-consuming machine is shown. The yarns 2 are supplied or fed in groups, in that four individual yarns 4, 5, 6, 7 are fed to the knitting machine 3 by a first group 8 of yarn feeders 11, 12, 13, 14. Further yarns 15, 15*a*, 15*b* are fed to the knitting machine 3 by a second group 16 of yarn feeders 17, 18, 19. Each yarn feeder 11, 12, 13, 14, 17, 18, 19 draws its own yarn 4, 5, 6, 7 for one group and 15, 15*a*, 15*b* for the other group from a spool 21, 22, 23, 24, 25, 26, 27. All the yarn feeders 11, 12, 13, 14 as well as 17, 18, 19 are connected to a central unit 31, which sends control commands to the yarn feeders 11, 12, 13, 14, 17, 18, 19. For transmitting the commands, a data bus 32 is used, to which all the yarn feeders 11, 12, 13, 14, 17, 18, 19 and the central unit 31 are connected. Via the data bus 32, the yarn feeders 11, 12, 13, 14, 17, 18, 19 can receive commands at least as a group and can individually transmit data to the central unit 31.

Figure 2:
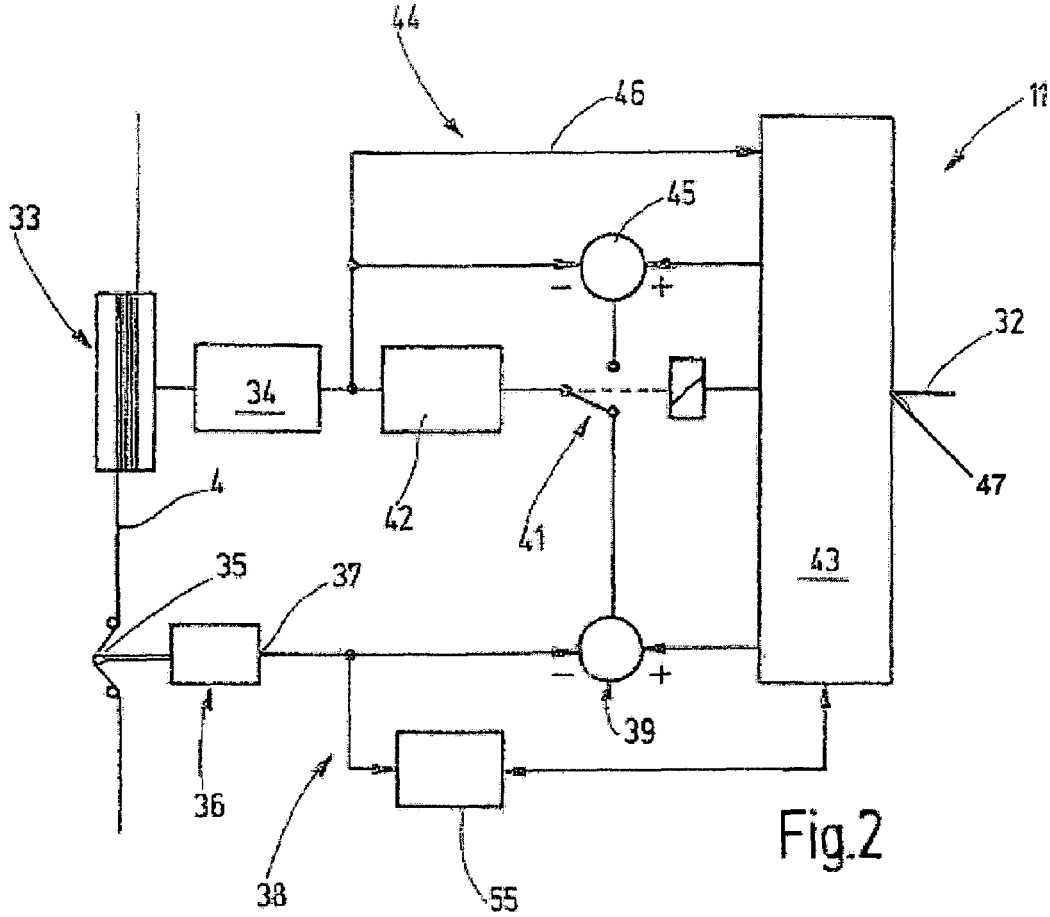
FIG. 2 is a schematic block circuit diagram of a yarn feeder in the system of FIG. 1.

FIG. 2 schematically shows the structure of the yarn feeder 11, as an example for the all the other yarn feeders 12, 13, 14, 17, 18, 19. Thus the following description applies accordingly to all the yarn feeders.

The yarn feeder 11 has a yarn feed wheel 33, around which the yarn 4 to be fed to the knitting machine 3 is wrapped in a plurality of windings. The yarn feeder is connected to the drive shaft of a motor 34, which can be operated at various rotary speeds. It is for instance a direct-current motor, a servo motor, or a stepping motor. In the present example of FIG. 2, it is assumed that the motor 34 is a permanently excited direct-current motor. The yarn 4, once it has left the yarn feed wheel 33, travels over a movable element 35, such as a feeler pin of a yarn tension sensor 36, that furnishes a yarn tension signal at its output 37. The yarn tension sensor 36 is part of a yarn tension regulator 38. The yarn tension regulator includes an adder 39, with which the difference between a yarn tension set-point signal and the actual yarn tension signal present at the output 37 is formed. This difference is delivered via a switch block 41 to an automatic gain control amplifier 42, which serves as a trigger circuit for the motor 34. The set-point signal for the yarn tension is furnished by a control unit 43. The control unit also controls the switch block 41.

The yarn feeders 11, 12, 13, 14, 17, 18, 19 are positive yarn feeders. This means that the yarn feed wheel has a plurality of yarn windings wrapped around it, preferably more than four yarn windings, and as a result the yarn is fed without slip. In some applications, however, it is considered to be entirely advantageous to allow a certain slip between the yarn feed wheel and the yarn. This can be done by wrapping only a few windings, for instance only two or three yarn windings, around the yarn feed wheel. As an alternative, one or more fixedly or movably supported yarn lifting elements, over which one or more yarn windings travel, may be disposed in the vicinity of the yarn feed wheel. The yarn raising elements may for instance be pins oriented substantially parallel to the axis of rotation of the yarn feed wheel. As a result, the yarn feed wheel can rotate faster below the yarn, and the lagging of the yarn relative to the yarn feed wheel can or does occur both in the trial phase and in the production phase. For instance, the yarn feed wheel can rotate 10% faster than yarn is fed. If the yarn raising elements are disposed fixedly, that is, not adjustably by means of the yarn tension, then as a rule a predictable, replicable slip occurs.

The yarn feeder 11 contains, besides the yarn tension regulator 38, a feed quantity regulator, here called the yarn speed regulator 44. The yarn speed regulator includes an adder 45, which forms the difference between a set-point yarn speed signal and an actual yarn speed signal. This difference is carried to the switch block 41 and by way of it, given a suitable position of the switch block, is sent to the input of the automatic gain control amplifier 42. The actual yarn speed signal can be picked up as a voltage signal at the output of the automatic gain control amplifier 42, if the operating voltage of the motor 34 corresponds with sufficient precision to the rpm of the motor. The yarn speed regulator 44 receives its set-point yarn speed signal from the control unit 43. The control unit is furthermore supplied, via a line branch 46, with a signal which corresponds to the yarn speed.

The control unit 43 has an input 47 that is connected to the data bus 32.

Figure 4:
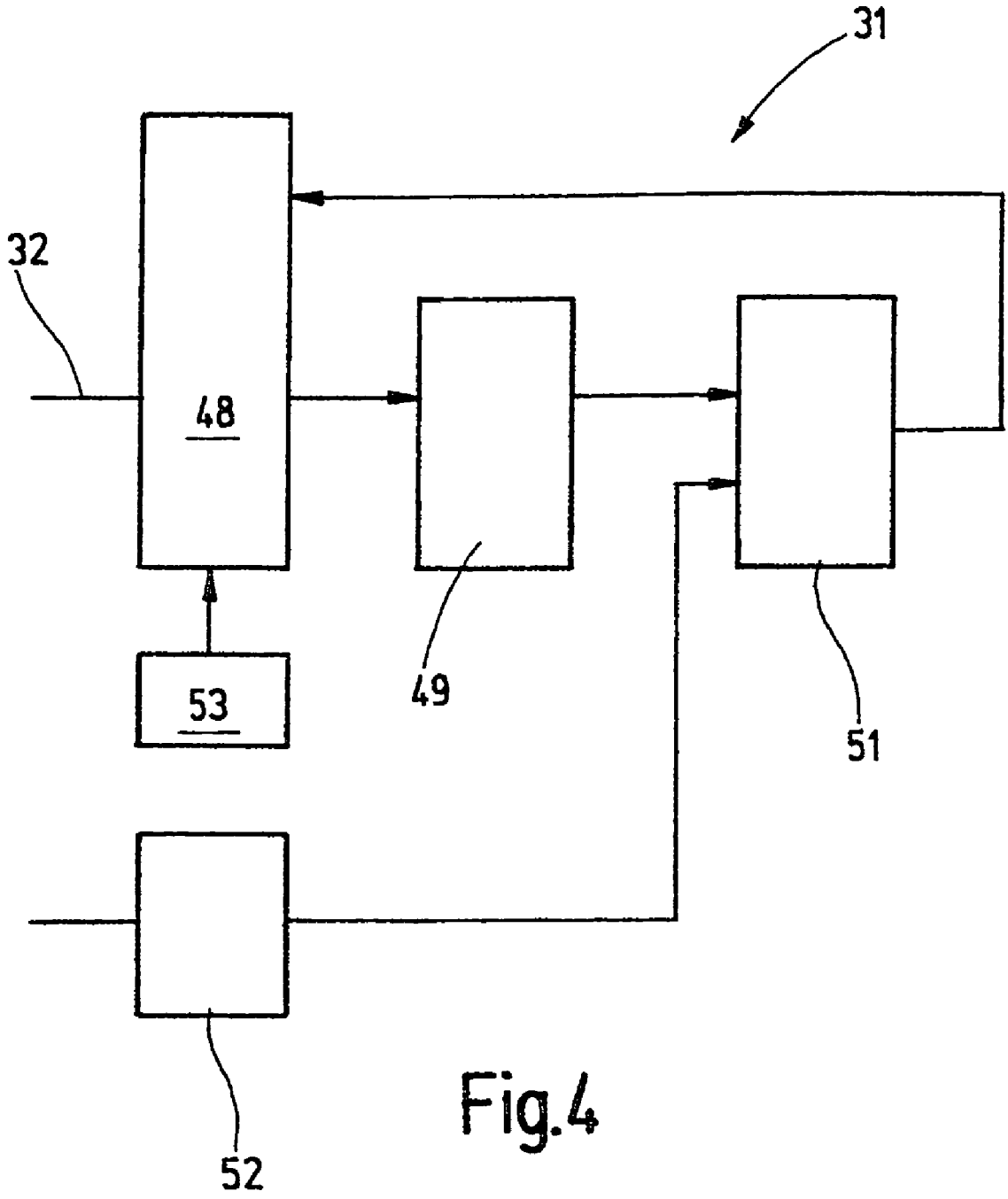
FIG. 4 is a block circuit diagram of the central unit of the system of FIG. 1.

In FIG. 4, the central unit 31 is shown in simplified form. For connection to the data bus 32, the central unit 31 has a communications block 48, which can both respond to individual yarn feeders 11, 12, 13, 14, 18, 19 and send data to them and also receive data from them. The communications block 48 is connected to a mean value former 49, which is set up to form the average from numerical values that the communications block 48 furnishes and that characterize the yarn feed speeds of the various yarn feeders 11, 12, 13, 14 of group 8 and 17, 19 of group 16. Moreover, the communications block 48 can send signals to the individual yarn feeders 11, 12, 13, 14 on the one hand and 17, 18, 19, on the other, which in turn cause their control unit 43 to switch the respective switch blocks 41 in such a way that either the yarn tension regulator 38 or the yarn speed regulator 44 is active.

The signal furnished by the mean value former 49 is delivered to a multiplication block 51, which multiplies the signal, formed by the mean value former 49, by a standardized machine rpm signal. This signal is received via an appropriate reception block 52, which is connected to an rpm sensor of the knitting machine 3. The multiplication block 51 furnishes a signal to the communications block 48, which furnishes the thus-ascertained signal to the yarn feeders as a set-point yarn speed signal.

An input device 53 is connected to the communications block 48 and serves to switch the yarn feeder system 1 from the trial mode of operation to regular operation and to perform other input tasks. More details are provided in the following functional description.

The yarn feeder system 1 is a positive yarn feeder system which also has a trial mode of operation. For performing the trial mode, the input device is actuated in such a way that the central unit 31 sends a trial mode signal to the yarn feeders 11, 12, 13, 14 of group 8 and/or to the yarn feeders 17, 18, 19 of group 16. Thus the switch blocks 41 of the particular yarn feeders, belonging to the group 8 or 16 that is addressed, switch over to the lower position shown in FIG. 2, in which the yarn tension regulators 38 are activated. Next, the central unit 31 sends a set-point yarn tension signal, which is supplied to the yarn tension regulator 38 by the respective control unit 43. In the ensuing trial mode, the yarn tension regulator regulates the tension at each yarn feeder to the desired yarn tension. The result at the various yarn feeders 11, 12, 13, 14 on the one hand and 17, 18, 19, on the other, may have different yarn feeding speeds (or yarn feeding quantities per machine revolution), as a consequence of the different yarn consumption of the various knitting stations connected. These yarn speeds are detected and sent on to the control unit 43 via the line branch 46. This control unit sends the yarn feeding speeds to the central unit. This can be done periodically, continuously, at the end of the trial mode, or alternatively by the request of the central unit 31. Once a trial mode has been performed, the yarn speeds and yarn feeding quantities of all the yarn feeders 11, 12, 13, 14, 17, 18, 19 are present in this central unit. The yarn feeding quantities of each group 8, 16 are now averaged for individual groups by the mean value former 49 and stored in memory.

For the ensuing operation of the knitting machine 3, the averaged yarn speed (yarn feeding quantity per machine revolution) is made the basis, as a set-point value, for the yarn feeders 11, 12, 13, 14, 17, 18, 19 connected.

To that end, the communications block 48 first sends a switching signal to the switch blocks 41 of the various yarn feeders 11, 12, 13, 14, 17, 18, 19. The yarn feeders thus switch on the yarn speed regulator 44. From then on, the central unit 31, whenever the machine speed changes, sends the yarn speed signal, generated in the multiplication block 51, to the connected yarn feeders, so that they furnish yarn quantities and yarn speeds that each match group for group. The yarn tensions of the yarns 4, 5, 6, 7 of group 8 can thus deviate considerably from one another, but because of the positive feeding, or in other words the feeding of fixed yarn quantities per unit of time, a uniform loop size is attained. The same is correspondingly true for the yarns 15, 15*a*, 15*b* of group 16.

In an alternative embodiment, the reception block 52 in FIG. 4 has an alternative task. It does not calculate new specified yarn speed values on the basis of the machine rpm constantly, but instead does this only once, at the end of the trial mode. After that, this speed is sent as a coefficient to the yarn feeders 11, 12, 13, 14, 17, 18, 19 and stored in memory there. The yarn feeders after that receive signals which characterize the respective current machine speed. The conversion of the yarn feeding speed in the trial mode to the current machine speed is then done in the control units 43.

The yarn feeder 11 of FIG. 2 can furthermore include a testing device 55, which, constantly or as needed, monitors the yarn tension detected by the yarn tension sensor 36. The input of the testing device 55 is connected for that purpose to the output 37. There is furthermore a connection with the control unit 43, so as to receive the set-point yarn tension value from it and send it an error signal if the deviation between the set-point and actual yarn tension values is too great. If such a case occurs during the operation of the yarn feeder 11, a suitable report can be sent over the data bus 32 to the central unit 31, which sends the report onward or stops the operation of the knitting machine 3.

Figure 3:
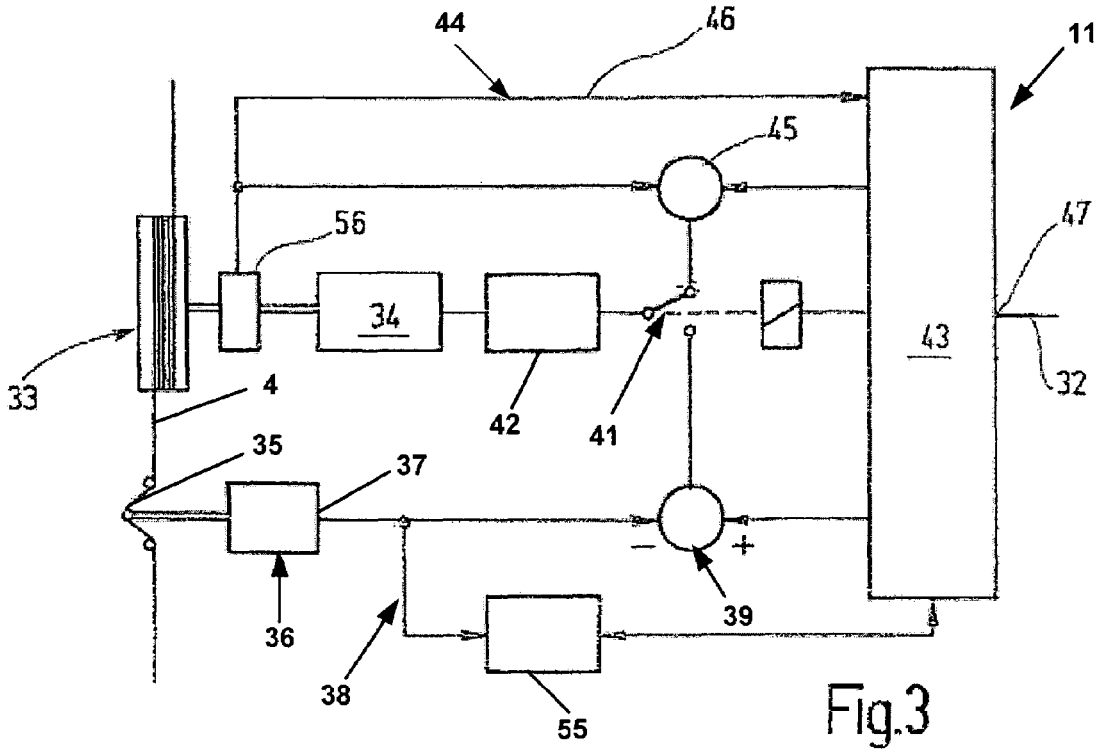
FIG. 3 is a block circuit diagram of a modified embodiment of a yarn feeder.

FIG. 3 shows a further modified embodiment of the yarn feeder 11. The deviation resides in the detection of the rpm of the motor, or the angular position of its yarn feed wheel 33. To that end, the motor 34, or its takeoff portion, is connected to an rpm sensor 56, whose output is connected to the adder 45 and, via the line branch 46, to the control unit 43. Otherwise, the above functional description also applies.

Figure 5:
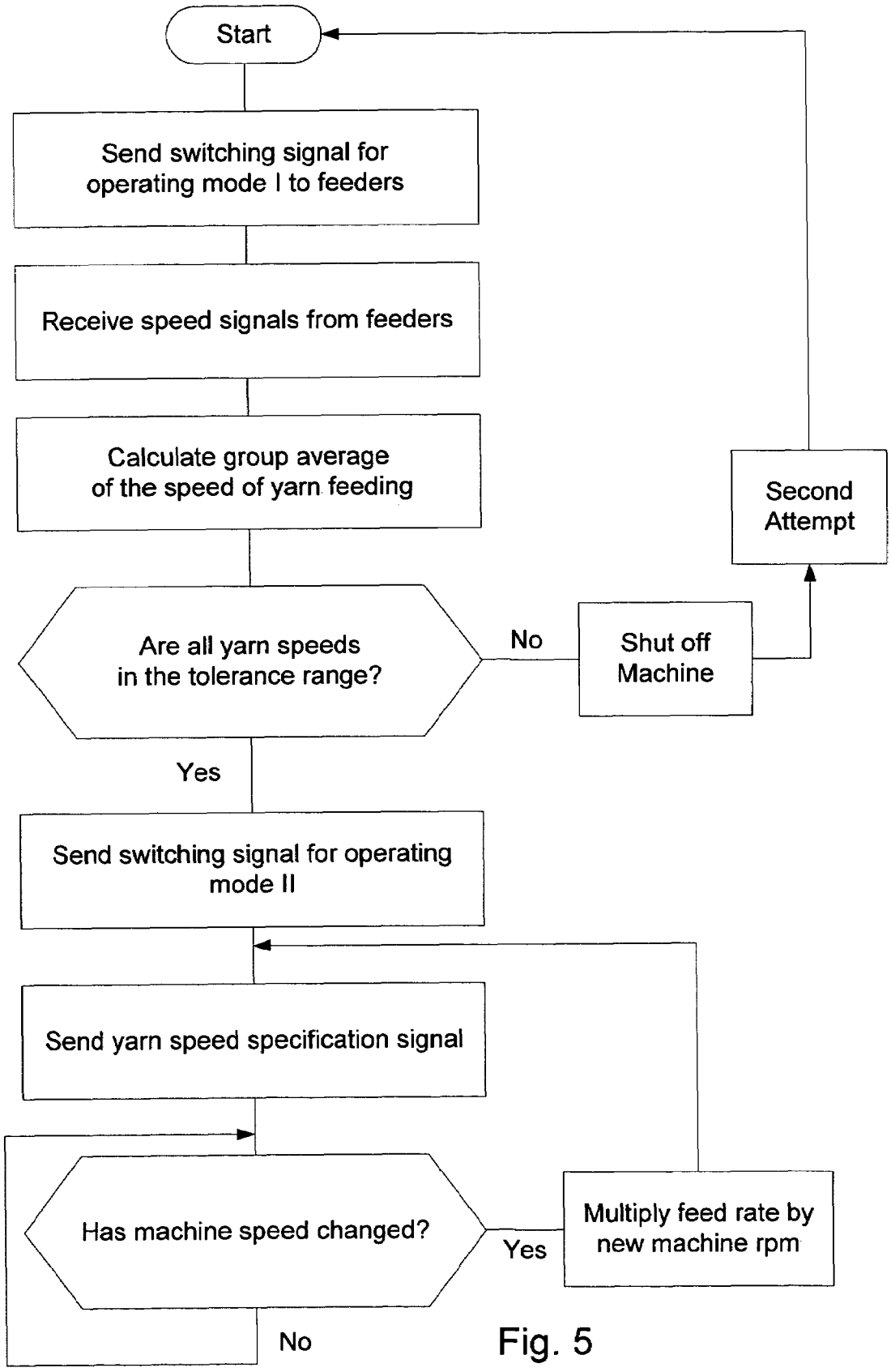
FIG. 5 is a flow chart to explain the function of the yarn feeder system of the invention.

This procedure is summarized in the flow chart of FIG. 5. According to this flow chart, in the processing of the various yarn speeds to form a group average, checking can additionally be done as to whether this average is within a tolerance range, so that errors can be detected.

In summary, a yarn feeder system 1 includes a plurality of yarn feeders 11, 12, 13, 14, which are combined into one group 8. In the trial mode, the yarn feeders 11, 12, 13, 14 operate in an individually tension-controlled manner on the basis of a specified yarn tension value. The yarn feed quantities or yarn speeds that result from this at the various yarn feeders 11, 12, 13, 14 are reported to a central unit. From the reported yarn speeds, the central unit calculates a group average and sends this to the yarn feeders 11, 12, 13, 14 as a specified value for subsequent operation. As a result, after that, the individual yarn feeders 11, 12, 13, 14 can operate in the purely positive mode. Moreover, the central unit 31, via an input 57, can receive both signals that characterize the machine speed (rpm) and pattern signals, on the basis of which the yarn feeders of the particular group 8 or 16 that is to respond at that time are switched on and off or speeded up or slowed down.

The invention claimed is:

1. A method of operating yarn feeders for feeding yarns to a textile machine, comprising:

in a trial phase, operating the yarn feeders in a tension-regulated mode;

detecting yarn feeding parameters of the yarn feeders operated in the tension-regulated mode, the determined yarn feeding parameters being of a type selected from yarn speed and yarn quantity fed;

determining, from the detected yarn feeding parameters detected during the trial phase, an operational yarn feeding parameter of said selected type; and in an operating phase, operating the yarn feeders according to the operational yarn feeding parameter.

2. A method as in claim 1, wherein the step of operating in the trial phase operates the yarn feeders in accordance with matching set-point tensions.

3. A method as in claim 1, wherein the step of detecting includes generating signals indicative of the detected yarn feeding parameters and delivering the signals over a signal line to a central control unit.

4. A method as in claim 3, wherein the signals are digital signals.

5. A method as in claim 1, wherein the yarn feeders includes a group of yarn feeders, and wherein the step of determining determines the operational yarn feeding parameter based on the detected yarn feeding parameters of all of the yarn feeders in said group.

6. A method as in claim 1, wherein the textile machine is a loop-forming machine, and wherein the operational yarn feeding parameter is set in proportion to a machine speed of the loop-forming machine.

7. A method as in claim 1, wherein the step of determining calculates the operational yarn feeding parameter as an average of a plurality of the detected yarn feeding parameters.

8. A method as in claim 7, wherein the step of determining includes weighting the plurality of detected yarn speeds or yarn quantities to form said average.

9. A method as in claim 1, further including generating an error signal if in the trial phase the detected yarn feeding parameters differ by more than a specified limit.

10. A method as in claim 1, further including detecting yarn tensions of the yarn feeders during the operating phase, and generating an error signal if the detected yarn tensions differ by more than a specified limit.

11. A method as in claim 1, wherein the operational yarn feeding parameter is sent as a control signal from a central control to the yarn feeders and stored in memories of the yarn feeders.

12. A method as in claim 11, wherein the control signal is a digital signal.

13. A yarn feeding system for feeding a plurality of yarns to a textile machine, comprising:

a plurality of yarn feeders that form an operational group, each of selected yarn feeders in the operational group having a yarn tension sensor, a drive motor with a yarn feed wheel, a yarn tension regulator, and a yarn speed regulator; and a central control connected to the yarn feeders for communicating with the yarn feeders, the central control being configured to receive, during a tension-regulated trial phase, first signals indicative of detected yarn feeding parameters of a type selected from yarn speed and yarn quantity, and send a control signal to the yarn feeders indicating an operational yarn feeding parameter of said selected type for controlling operations of the yarn feeders during an operating phase, wherein the yarn tension regulator and yarn speed regulator of each selected yarn feeder are alternatively activatable via a switching device.

14. A yarn feeding system as in claim 13, wherein the central control includes an arithmetic unit for determining the operational yarn feeding parameter from the detected yarn feeding parameters detected in the trial phase.

15. A yarn feeding system as in claim 13, wherein the textile machine is a loop-forming machine, and wherein the central control includes an input for receiving a signal indicative of an operating speed of the loop-forming machine.

* * * * *